US009624619B2

(12) United States Patent
Altinier et al.

(10) Patent No.: US 9,624,619 B2
(45) Date of Patent: Apr. 18, 2017

(54) ROTATABLE-DRUM LAUNDRY DRIER AND METHOD OF CONTROLLING A ROTATABLE-DRUM LAUNDRY DRIER TO DRY DELICATE LAUNDRY

(75) Inventors: Fabio Altinier, Codognè (IT); Michele Bisaro, Spilimbergo (IT); Roberto Ragogna, Malnisio (IT)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 869 days.

(21) Appl. No.: 13/990,153

(22) PCT Filed: Nov. 25, 2011

(86) PCT No.: PCT/EP2011/071015

§ 371 (c)(1),
(2), (4) Date: Sep. 25, 2013

(87) PCT Pub. No.: WO2012/072506

PCT Pub. Date: Jun. 7, 2012

(65) Prior Publication Data

US 2014/0020262 A1 Jan. 23, 2014

(30) Foreign Application Priority Data

Nov. 29, 2010 (EP) ..... 10192895

(51) Int. Cl.
*D06F 58/28* (2006.01)

(52) U.S. Cl.
CPC ..... *D06F 58/28* (2013.01); *D06F 2058/2838* (2013.01); *D06F 2058/2877* (2013.01); *D06F 2058/2896* (2013.01)

(58) Field of Classification Search
CPC ..... D06F 2058/2838; D06F 2058/2877; D06F 2058/2896; D06F 58/28
See application file for complete search history.

(56) References Cited

U.S. PATENT DOCUMENTS 3,436,838 A 4/1969 Helfrich
5,887,456 A * 3/1999 Tanigawa ..... D06F 25/00 34/596

(Continued)

FOREIGN PATENT DOCUMENTS

CH 659841 A5 2/1987
DE 1924961 A1 11/1970

(Continued)

OTHER PUBLICATIONS

International Search Report mailed Dec. 27, 2011 in corresponding International Application No. PCT/EP2011/071015.

(Continued)

*Primary Examiner* — Jiping Lu
(74) *Attorney, Agent, or Firm* — Banner & Witcoff, Ltd.

(57) ABSTRACT

A method of controlling a rotatable-drum laundry drier to dry delicate laundry in a drum of the rotatable-drum laundry drier. The method includes the steps of feeding drying air into the drum; rotating the drum at a variable rotation speed about an axis of rotation; rotating the drum at a first rotation speed higher than, or equal to a rotation speed, at which centrifugal acceleration of the inner surface of the drum equals gravitational acceleration; making interruptions in rotation of the drum at the first rotation speed; and performing, at each interruption, one or more rotation cycles at a second rotation speed, so that, at each cycle, at least part of the laundry slides/tumbles slowly inside the drum while remaining in contact with the inner surface of the drum and/or another part of the laundry contacting the drum.

18 Claims, 5 Drawing Sheets

(56) References Cited

U.S. PATENT DOCUMENTS

| | | | | |
|---|---|---|---|---|
| 6,941,674 | B2 * | 9/2005 | Park | D06F 58/28 34/557 |
| 2005/0044639 | A1 | 3/2005 | Kim et al. | |
| 2005/0188471 | A1 * | 9/2005 | Ahn | D06F 25/00 8/158 |
| 2007/0186438 | A1 * | 8/2007 | Woerdehoff | D06F 58/28 34/486 |

FOREIGN PATENT DOCUMENTS

| | | | |
|---|---|---|---|
| EP | 0937810 | A1 | 8/1999 |
| EP | 1103648 | A2 | 5/2001 |
| EP | 1975303 | A1 | 10/2008 |
| EP | 2014822 | A1 | 1/2009 |
| JP | 11057297 | A * | 3/1999 |
| WO | 2007066863 | A1 | 6/2007 |

OTHER PUBLICATIONS

European Search Report dated May 4, 2011 in corresponding EP Application No. 10192895.0.

* cited by examiner

ROTATABLE-DRUM LAUNDRY DRIER AND METHOD OF CONTROLLING A ROTATABLE-DRUM LAUNDRY DRIER TO DRY DELICATE LAUNDRY

BACKGROUND

Embodiments of the present invention relates to a rotatable-drum laundry drier, and to a method of controlling a rotatable-drum laundry drier to dry delicate laundry.

Drying delicate laundry, such as woolens or similar, in a rotatable-drum laundry drier is a risky operation, on account of the known tendency of delicate laundry to felt and/or undergo other damage. Both these tendencies depend substantially on a combination of two critical drying factors, such as drying air temperature and surface rubbing of the laundry against other laundry items or the inner wall of the drum as it rotates.

To reduce rubbing of the laundry, a method of controlling a rotatable-drum laundry drier has been devised whereby, substantially, the drum is controlled to reach, during the drying cycle, such a rotation speed that delicate laundry is pressed by centrifugal force against the inner wall of the drum, to which it adheres, so as to be prevented from sliding/tumbling inside the drum. A method of this sort is described, for example, in EP 2014822.

The above method is particularly advantageous, in that, besides reducing rubbing of the laundry inside the drum, the method also allows accurate laundry moisture measurement using electronic control systems comprising measuring sensors/electrodes fitted to the inner wall of the drum and directly contacting the laundry. That is, keeping the laundry clamped against the inner wall of the rotating drum ensures effective contact between the sensors/electrodes and the laundry and, hence, accurate moisture measurement, enabling the electronic control system to determine completion of the drying operation and, hence, when to stop the drying cycle.

Though effective, the above method is not altogether suitable for use in rotatable-drum laundry driers in which the measuring sensors/electrodes, instead of being located inside the drum, directly contacting the laundry, are connected to a stationary part of the casing in such a way to face the loading/unlading opening in the drum.

Research by the Applicant, in fact, shows that, when the above control method is implemented in a rotatable-drum laundry drier in which the measuring sensors/electrodes are located outside the drum, i.e. in a lateral position facing the opening in the drum, clamping the laundry to the rotating drum greatly reduces the probability that the laundry contacts the sensors/electrodes in such a way to effectively detect the moisture of the laundry, which may result in an incorrect laundry moisture measurement and, in some cases, as, for example, with small laundry loads, in no moisture measurement at all.

Without an accurate moisture measurement, the electronic control system is therefore unable to accurately determine when to stop the cycle, thus resulting in either incomplete drying of the laundry, or temporary overheating and, hence, felting of delicate items.

In-depth research has been carried out by the Applicant to achieve the following specific goals:

- reduce felting and damage to delicate laundry, particularly woolens;
- accurately measure laundry moisture, even when the moisture measuring sensors/electrodes are located outside the drum;
- accurately calculate when to stop the drying cycle, even when the measuring sensors/electrodes are located outside the drum.

SUMMARY OF SELECTED INVENTIVE ASPECTS

It is therefore an object of the present invention to provide a solution designed to achieve the above goals.

According to embodiments of the present invention, there is provided a method of controlling a rotatable-drum laundry drier to dry delicate laundry, as claimed in the accompanying Claims.

In detail, a first aspect of the present invention provides a method of controlling a rotatable-drum laundry drier to dry delicate laundry in a drum of the rotatable-drum laundry drier, wherein the method comprises the steps of feeding drying air into the drum; rotating the drum at a variable rotation speed about an axis of rotation; rotating the drum at a first rotation speed higher than, or equal to, a rotation speed, at which centrifugal acceleration of the inner surface of the drum equals gravitational acceleration, so that the laundry is pressed by centrifugal force against the inner surface of the drum and so prevented from sliding/tumbling inside drum; and alternating first rotation cycles of drum at the first speed with one or more second rotation cycles of the drum at a not null second speed, lower than the first rotation speed, so that, at each second rotation cycle, at least part of the laundry slides/tumbles slowly inside the drum while remaining in contact with the inner surface of the drum and/or another part of the laundry contacting the drum.

In some embodiments, the method comprises two or more second rotation cycles at a second rotation speed lower than the first rotation speed and such that, at each second rotation cycle, at least part of the laundry slides/tumbles slowly inside the drum while remaining in contact with the inner surface of the drum and/or another part of the laundry contacting the drum.

Advantageously, in two different second rotation cycles at a second rotation speed, the direction of rotation of the drum is the same, or the direction of rotation of the drum in a second rotation cycle at a second rotation speed is different from the direction of rotation of the drum in a different second rotation cycle at a second rotation speed.

In some embodiments the drum is stopped between two subsequent second rotation cycles at seconds rotation speeds, and/or between the end of a first rotation cycle at the first rotation speed and the following second rotation cycle at a second rotation speed, and/or between the end of a second rotation cycle at a second rotation speed and the following first rotation cycle at the first rotation speed.

In some embodiments the second rotation speed of the drum is the same during all the second rotation cycles at second rotation speeds, or the second rotation speed of the drum in a second rotation cycle at a second rotation speed is different from the second rotation speed of the drum during a different second rotation cycle at a second rotation speed.

In some embodiments, the method comprises the steps of making interruptions in rotation of the drum at the first rotation speed; commanding, at each interruption in rotation at least two or more second rotation cycles of the drum at the second rotation speed; alternating rotations of the drum in a first rotation direction with rotations of the drum in a second rotation direction, opposite the first, during the second rotation cycles of the drum at the second rotation speed, so as to produce controlled movement of the laundry inside the drum.

In some embodiments, during each second rotation cycle of the drum at the second rotation speed, the drum performs at least a partial revolution.

In some embodiments the method comprises the step of measuring the moisture in the laundry, in the course of one or more second rotation cycles of the drum at the second rotation speed, by means of moisture sensors associated to a stationary part of the casing of the rotatable-drum laundry drier and located so that, as the drum rotates, they come into contact with the laundry inside the drum.

In some embodiments, the method comprises the step of regulating the number of second rotation cycles of the drum at the second rotation speed, on the basis of the number of contacts between moisture sensors and laundry.

In some embodiments, the method comprises the step of adjusting said second rotation speed of the drum during each second rotation cycle at the second rotation speed, on the basis of the number of contacts between moisture sensors and laundry.

In some embodiments, the method comprises the step of adjusting the alternating rotation directions of the drum during said second rotation cycles at the second rotation speed, on the basis of the number of contacts between moisture sensors and laundry.

In some embodiments, the method comprises the step of adjusting the duration of each second rotation cycle at the second rotation speed, on the basis of the number of contacts between moisture sensors and laundry.

In some embodiments, the method comprises the step of adjusting the interval between two consecutive second rotation cycles at the second rotation speed, on the basis of the number of contacts between moisture sensors and laundry.

In some embodiments, moisture sensors comprise at least two electrodes located outside the drum and facing a lateral opening in the drum, and the method comprises the steps of calculating, during the second rotation cycles of the drum at the second rotation speed, the moisture and the quantity/weight of the laundry, and calculating the drying cycle end time of the rotatable-drum laundry drier on the basis of the moisture and the quantity/weight of the laundry.

In some embodiments, the method comprises the step of determining a first electric quantity indicating the resistance/conductance/impedance of the laundry measured by the electrodes during the second rotation cycles at the second rotation speed performed at each interruption in rotation of the drum at the first rotation speed; calculating, on the basis of the first electric quantity, a second quantity related to both the total quantity/weight of the laundry in the drum and the moisture in the laundry; and calculating the end-of-cycle time as a function of the second quantity.

In some embodiments the second drum rotation speed ranges between 5 and 20 revolutions/minute.

In some embodiments, the second drum rotation speed is roughly 10 revolutions/minute.

In some embodiments, during each second rotation cycle of the drum at the second rotation speed, the drum performs a partial revolution.

In some embodiments, each second rotation cycle of the drum at the second rotation speed lasts at least 2-3 seconds.

In some embodiments, between two consecutive second rotation cycles of the drum at the second rotation speed, the drum remains stationary for roughly 2-3 seconds.

In some embodiments, each interruption in rotation of the drum at the first rotation speed lasts roughly 1 minute.

A second aspect of the present invention provides a rotatable-drum laundry drier comprising a drum for housing delicate laundry; means for feeding drying air into the drum; and means for rotating the drum at a variable rotation speed about an axis of rotation; and an electronic control system configured to implement the delicate-laundry drying method according to embodiments of the present invention.

A third aspect of the present invention provides an electronic control system for controlling a rotatable-drum laundry drier, and configured to implement a delicate-laundry drying method according to embodiments of the present invention.

BRIEF DESCRIPTION OF THE DRAWINGS

A non-limiting embodiment of the present invention will be described by way of example with reference to the accompanying drawings, in which.

DETAILED DESCRIPTION OF EXAMPLE EMBODIMENTS

Figure 1:
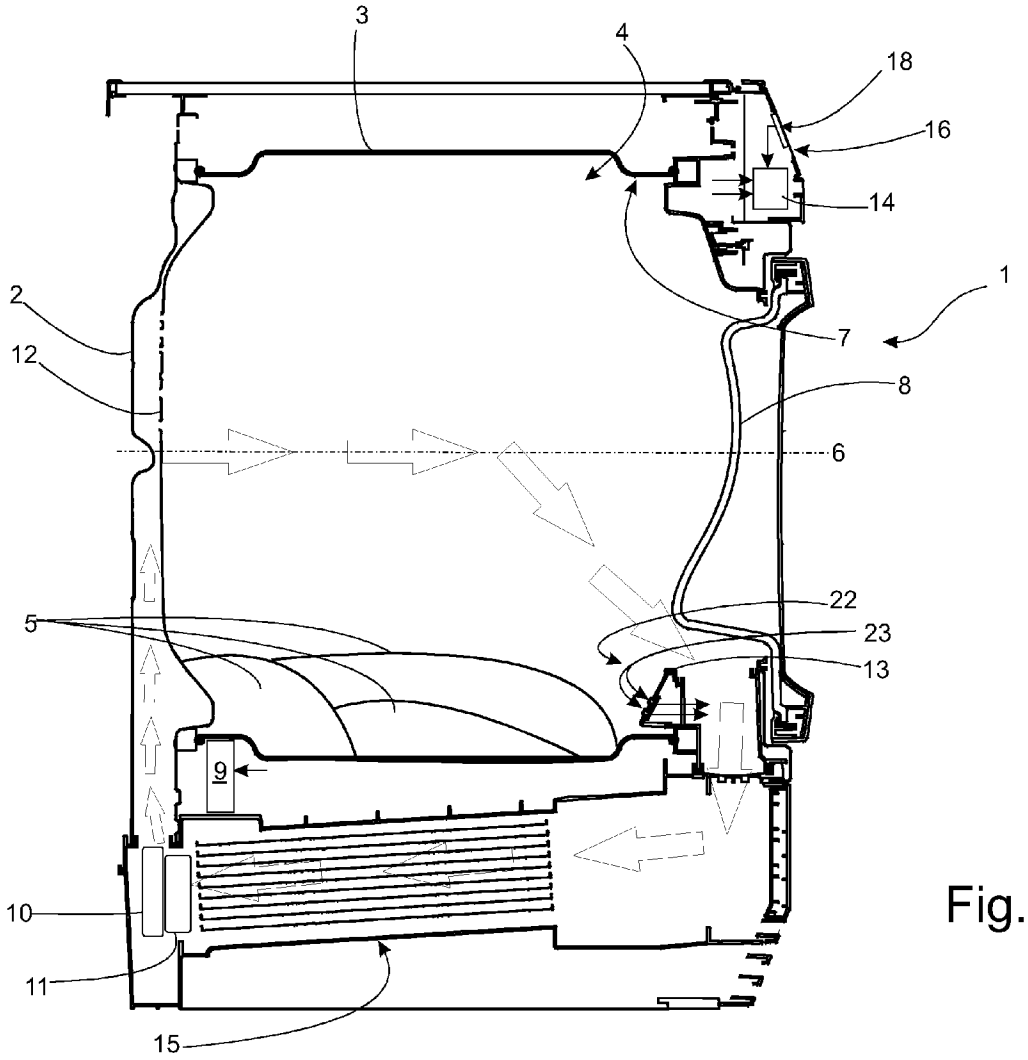
FIG. 1 shows a schematic lateral cross section of a rotatable-drum laundry drier implementing the delicate laundry drying control method according to an embodiment of the present invention.

Number 1 in FIG. 1 indicates as a whole a rotatable-drum laundry drier comprising an outer casing 2 that preferably rests on the floor on a number of feet.

Casing 2 supports a rotatable laundry drum 3, which defines a drying chamber 4 for laundry 5 and rotates about a preferably, though not necessarily, horizontal axis of rotation 6. In an alternative embodiment not shown, axis of rotation 6 may be vertical or inclined. Drying chamber 4 has a front access opening 7 closable by a door 8 preferably hinged to casing 2.

Drum 3 may be rotated about axis of rotation 6 by an electric motor 9, and is fed with hot air heated by a heating device 10 and fed into drum 3 preferably by a fan 11. Fan 11 may preferably, though not necessarily, be driven by electric motor 9 (shown schematically in FIG. 1) or, in an alternative embodiment (not shown), by an auxiliary electric motor (not shown) independent of electric motor 9.

In the FIG. 1 example, one opened side of the drum 3 of the laundry drier 1 is advantageously associated, in a rotatable and substantially air-tight way, to a perforated inner wall 12 fixed to a lateral wall of casing 2 and through which hot air flows into drum 3; the other opened side of the drum 3 is advantageously associated, in a rotatable and substantially air-tight way, to a flange 13 fixed to casing 2 and interposed between door 8 and front access opening 7 of drum 3.

Figure 2:
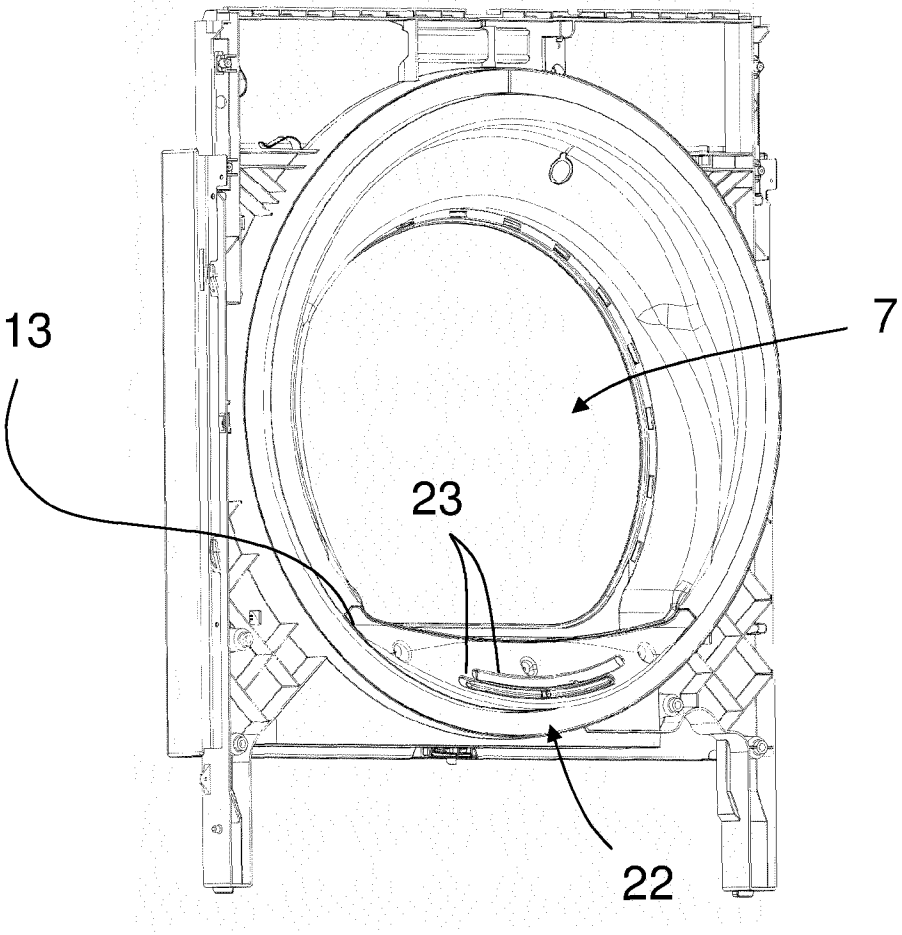
FIG. 2 shows an inner lateral wall of the FIG. 1 rotatable-drum laundry drier, housing moisture measuring sensors/electrodes.

In the FIGS. 1 and 2 example, flange 13 is fixed firmly to casing 2, and is positioned at front opening 7 so as to project at least partly inside drum 3, so that its inner surface faces the laundry 5 when the latter is loaded into the drum 3.

Heating device 10 may advantageously comprise one or more electric heating components, such as electric resistors (not shown), or, in an alternative embodiment, a heat pump.

In actual use, fan 11 blows a stream of drying air, produced by heating device 10, preferably through perforated inner wall 12 into drum 3. After contacting laundry 5 inside drum 3, the moisture-laden drying air flows out of drum 3 and it is preferably directed to a condensing device 15, which cools the drying air to condense the moisture inside it. For this purpose, condensing device 15 may be supplied with cold air from outside the drier, and feeds the moisture-free air to fan 11. It should be pointed out that condensing device 15 as described above applies, purely by way of example, to one possible embodiment of the present invention, and may be omitted in the case of an exhaust-type rotatable-drum laundry drier 1 (i.e. in which the hot and moisture-laden drying air from the rotatable laundry drum 3 is expelled directly out of rotatable-drum laundry drier 1).

Rotatable-drum laundry drier 1 also comprises an electronic control system 16 configured to control rotatable-drum laundry drier 1 on the basis of a drying cycle, preferably selected by a user, for example by using a user control interface 18, and to implement a delicate-laundry drying cycle for laundry such as woolens or similar.

Electronic control system 16 advantageously comprises an electronic control unit 14 (which may coincide or not with the electronic control system 16) preferably configured to control heating device 10 and/or fan 11 to regulate the temperature and/or flow of hot air into drum 3 according to the selected laundry drying cycle.

Advantageously, electronic control unit 14 is also configured to control electric motor 9 during the delicate-laundry drying cycle for regulating the rotation speed of drum 3.

Advantageously, during the drying cycle, electronic control unit 14 controls electric motor 9 to rotate drum 3 at a first rotation speed V1 greater than, or equal to, a rotation speed, at which centrifugal acceleration of the inner surface of drum 3 equals gravitational acceleration, so that laundry 5 is pressed by centrifugal force against the inner surface of drum 3, and so prevented from sliding/tumbling inside drum 3.

Figure 3:
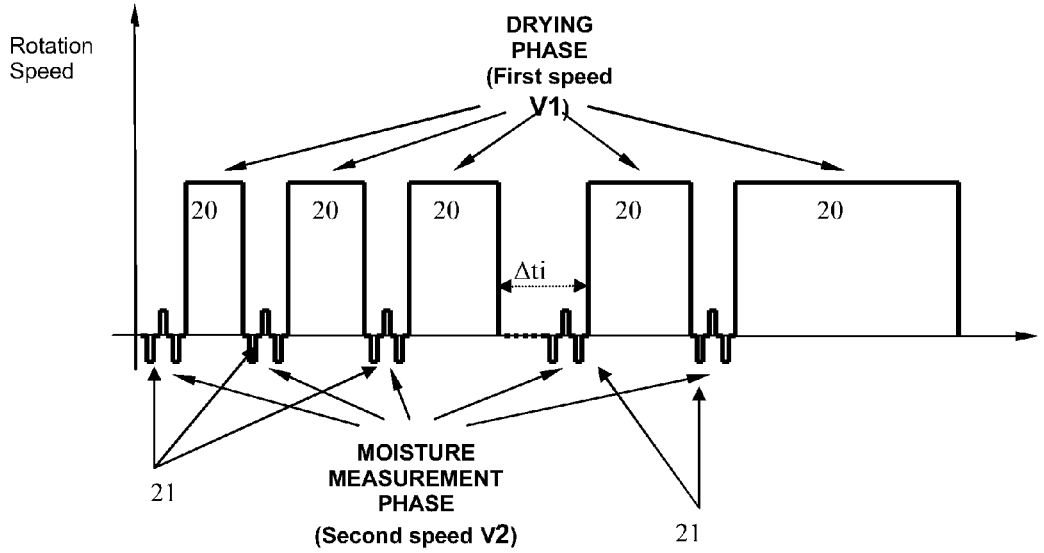
FIG. 3 shows a graph of the drum rotation speed Vs time, of the FIG. 1 rotatable-drum laundry drier at the initial stage of a drying cycle.

Advantageously, with reference to FIG. 3 (in which the horizontal axis indicates the time, and the vertical axis indicates the rotation speed of the drum), during the delicate-laundry drying cycle, electronic control unit 14 controls electric motor 9 to alternate first rotation cycles 20 of drum 3 at the first speed V1, with one or more second rotation cycles 21 of the drum 3 at a not null second speed V2, lower than first speed V1, and such that, at each second rotation cycle 21, at least part of the laundry 5 is not pressed by centrifugal force against the inner surface of drum 3 and so slides/tumbles slowly inside the drum 3 while remaining in contact with the inner surface of the drum 3 and/or with another part of the laundry 5 contacting the drum 3.

In other words, during the delicate-laundry drying cycle, electronic control unit 14 alternates "high-speed" first rotation cycles of drum 3—corresponding to first speed V1, and during which laundry 5 adheres to the inner surface of drum 3 and is prevented from sliding/tumbling inside drum 3—with one or more "low-speed" second rotation cycles of drum 3—corresponding to second speed V2, and during each of which part of laundry 5 slides slowly on the inner surface of drum 3 and/or over other laundry underneath, to the bottom dead centre point of drum 3. In detail, the bottom dead centre point of drum 3 is, at a certain instant, the inner point of the drum 3 nearest to the resting drier plane, i.e. the floor.

In a preferred embodiment, during the delicate-laundry drying cycle, electronic control unit 14 controls electric motor 9 to repeatedly interrupt the rotation of drum 3 at first rotation speed V1. At each interruption, electronic control unit 14 controls electric motor 9 to perform one or more second rotation cycles of drum 3 at a second speed V2, so that, during each of these cycles, at least part of the laundry slides/tumbles slowly inside drum 3 while remaining in contact with the inner surface of drum 3 and/or with another part of laundry 5 contacting the inner surface of drum 3.

Figure 4:
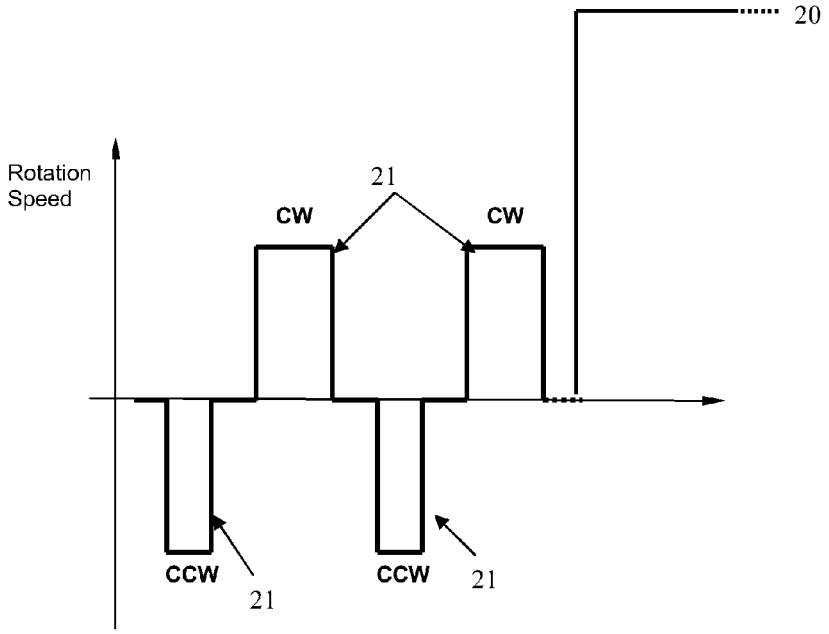
FIG. 4 shows a number of low-speed cycles performed by the FIG. 1 rotatable-drum laundry drier.

Advantageously, as illustrated for example in FIG. 3 and in FIG. 4 (in which the horizontal axis indicates the time, and the vertical axis indicates the rotation speed of the drum), between two "high-speed" first rotation cycles (indicated as 20 in FIG. 3) of drum 3 at first speed V1 there may be one, two, or more than two "low-speed" second rotation cycles 21 at a second speed V2 lower than V1 and such that at least part of the laundry 5 is not pressed by centrifugal force against the inner surface of drum 3 and so slides/tumbles slowly inside the drum 3 while remaining in contact with the inner surface of the drum 3 and/or with another part of the laundry 5 contacting the drum 3.

If in a delicate-laundry drying cycle there are two or more "low-speed" second rotation cycles 21, the direction of rotation of the drum 3 in a "low-speed" second rotation cycle 21 may be the same, of or may be different from the direction of rotation of the drum 3 in another "low-speed" second rotation cycle 21.

Preferably, but not necessarily, the drum 3 may be stopped for a period of time between two subsequent "low-speed" second rotation cycles 21 and/or between the end of a "high-speed" first rotation cycle 20 and the following "low-speed" second rotation cycles 21, and/or between the end of a "low-speed" second rotation cycle and the following "high-speed" first rotation cycle.

Advantageously, the second speed V2 of the drum during a "low-speed" second rotation cycle 21 may be the same of or may be different from the second speed V2 of the drum during a different "low-speed" second rotation cycle 21, provided that all the second rotation speeds are not null and that they are lower than the first rotation speed V1, in such a way that while rotating the drum 3 at these second rotation speeds V2, at least part of the laundry 5 is not pressed by centrifugal force against the inner surface of drum 3 and so slides/tumbles slowly inside the drum 3 while remaining in contact with the inner surface of the drum 3 and/or with another part of the laundry 5 contacting the drum 3.

Rotation of drum 3 at second speed V2 causes laundry 5 to slide conveniently in controlled manner inside drum 3, thus reducing the mechanical stress on laundry 5 caused by its tumbling inside drum 3, and also redistributing laundry 5 inside drum 3 as required for the next "high-speed" first rotation cycle.

Moreover, as it slides slowly inside drum 3, laundry 5 is shuffled continually, thus repeatedly changing the overall surface area of laundry 5 swept by the hot airflow, and so achieving effective drying action even at "low" rotation speed. The method according to the present invention provides therefore for increasing the surface area of the laundry swept by the drying air, by moving the laundry slowly but continually inside drum 3 also during the one ore more second rotation cycles 21 at a second speed V2.

The slow movement of the laundry inside the drum during second rotation cycles 21 at a second speed V2 is particularly advantageous in rotatable-drum laundry driers 1 with rotation systems in which one electric motor 9 drives both fan 11 and drum 3, so that the hot-air feed into drum 3 by the fan 11, necessarily also calls for electric motor 9 rotating the drum. Unlike known methods employed in rotatable-drum laundry driers with one electric motor for both the fan and drum, and in which stopping the drum also cuts off the airflow and so stops the drying action, the method according to the present invention also ensures low-speed rotation of fan 11 during "low-speed" rotation of drum 3, to feed hot air into drum 3 and so dry laundry 5 as it is shuffled.

FIG. 3 shows a graph of the rotation speed of drum 3 during a delicate-laundry drying cycle, and which shows the first rotation cycles (indicated 20) at first rotation speed V1, interrupted cyclically by second rotation cycles (indicated 21) at second rotation speed V2.

As shown in FIGS. 3 and 4, to enhance shuffling and, hence, drying of laundry 5 in drum 3 at each second rotation cycle 21, electronic control unit 14 may be advantageously configured to run electric motor 9 in alternating opposite directions, so that each turn of drum 3 in one, e.g. clockwise, rotation direction CW is followed by a turn of drum 3 in the opposite, e.g. counterclockwise, rotation direction CCW.

In one possible embodiment, first drum rotation speed V1 is roughly 70 rpm (revolutions per minute) and more generally may range between 60 and 75 rpm for a 575 mm diameter drum 3.

In one embodiment, second drum rotation speed V2 ranges between 3 and 20 rpm, and is preferably about 10 rpm for a 575 mm diameter drum 3.

As shown in FIGS. 3 and 4, electronic control unit 14 is preferably configured to control electric motor 9 so that drum 3 performs a number of second rotation cycles 21 within a interruption interval Δti between two consecutive high-speed first rotation cycles 20.

In one embodiment, interruption interval Δti lasts a total of about one minute; and second rotation cycles 21 may be advantageously separated by roughly 2-3-second pauses, and each last roughly 2-3 seconds.

With reference to FIGS. 1 and 2, electronic control system 16 may advantageously comprise moisture sensors 22 for measuring the moisture in laundry 5, in particular during the delicate-laundry drying cycle. Moisture sensors 22 advantageously comprise at least one pair of electrodes 23 located preferably in flange 13 and positioned facing the inside of drum 3; electronic control unit 14 is configured to determine the moisture in the laundry as a function of an electric quantity Z(ti), e.g. resistance and/or conductance and/or impedance, measured between electrodes 23.

In one embodiment, moisture is determined by conveniently measuring electric quantity Z(ti), i.e. resistance and/or conductance and/or impedance, between electrodes 23 during second rotation cycles 21 at second rotation speed V2.

By rotating drum 3, preferably but not necessarily clockwise and counterclockwise, during low-speed second rotation cycles 21, as described above, electronic control unit 14 provides for moving laundry 5 in such a way to increase the probability that the load 5 effectively contacts the electrodes 23. In other words, the slow rotation speed V2 of the drum 3 during the low-speed second rotation cycles 21 increases the probability that the laundry 5 contained in the drum 3 contacts the electrodes 23 in a way effective to allow these electrodes 23 to detect the moisture of the laundry 5; during the rotation of the drum 3 at the high rotation speed V1, the laundry 5 is instead pressed by the centrifugal force against the inner surface of drum 3, and therefore the probability that this laundry 5 contacts the electrodes 23 is highly reduced.

In one embodiment, electronic control unit 14 may be designed: to determine the number of contacts between laundry 5 and electrodes 23 on the basis of variations in the electric quantity Z(ti) measurement; and to regulate the number of second rotation cycles 21 at second rotation speed V2, and/or the rotation direction of drum 3 at each second rotation cycle 21, and/or the duration of each second rotation cycle 21 of drum 3, and/or second rotation speed V2 of drum 3, and/or the duration of interruption interval Δti, on the basis of the number of contacts between laundry 5 and electrodes 23. For example, if the number of contacts recorded during second rotation cycles 21 at second rotation speed V2 during interruption interval Δti is low, i.e. too few to ensure an accurate moisture measurement, electronic control unit 14 may advantageously increase the number of second rotation cycles 21, and/or reduce second rotation speed V2, and/or alter the alternating rotation directions of drum 3.

In a one embodiment, electronic control unit 14 may be configured to control electric motor 9 so that the drum 3 performs a partial turn, e.g. a 120° rotation with respect to its bottom dead centre position, at each second rotation cycle 21 at second rotation speed V2. Electronic control unit 14 may be advantageously configured to control electric motor 9 so that the drum 3 performs a number of clockwise and counterclockwise partial turns to cause the drum 3 to oscillate above the axis of rotation 6.

The rotation angle of drum 3 during a second rotation cycle 21 may be adjusted, for example, on the basis of the number of contacts between laundry 5 and electrodes 23 recorded at the preceding interruption interval Δti.

Tests conducted by the Applicant show that, by appropriately adjusting the duration of each second rotation cycle 21, and/or second rotation speed V2, and/or interruption interval Δti, and/or the rotation angle of drum 3 in the case of a single rotation, it is possible to increase the number of contacts between laundry 5 and electrodes 23, and so increase the number of instantaneous laundry resistance/conductance/impedance measurements, to achieve a more accurate moisture calculation.

In a one embodiment, electronic control unit 14 may be configured to interrupt rotation of drum 3 at second rotation speed V2, and rotate the drum at first rotation speed V1, when the number of contacts between laundry 5 and electrodes 23 exceeds a given contact threshold sufficient to achieve an accurate moisture calculation.

Electronic control unit 14 may be configured to determine, during the second rotation cycles of drum 3 at second rotation speed V2, a quantity indicating the moisture and quantity/weight of laundry 5; and to calculate the drying cycle end time "CycleTime" of drier 1 accordingly. It should be noted that drying cycle end time CycleTime is the time at which electronic control unit 14 stops rotation cycles of the drum 3 and turns off the heating device 10.

Electronic control unit 14 is preferably configured to determine a first electric quantity Zm(ti) indicating the laundry resistance/conductance/impedance measured by electrodes 23 during second rotation cycles 21 at second rotation speed V2 at each interruption interval Δti.

Electronic control unit 14 is preferably configured to calculate end-of-cycle time CycleTime as a function of this first electric quantity Zm(ti).

Electronic control unit 14 is preferably configured to calculate, on the basis of above mentioned first electric quantity Zm(ti), a second quantity "IntSlope" related to both the total quantity/weight of the laundry in drum 3 (i.e. the nominal quantity/weight of the laundry when dry, and the quantity/weight of the moisture in the laundry) and the moisture in the laundry; and to calculate end-of-cycle time CycleTime as a function of second quantity IntSlope.

In a one embodiment, first electric quantity Zm(ti) corresponds to the mean value of the resistances/conductances/impedances Z(ti) measured during second rotation cycles 21 at second rotation speed V2 at each interruption interval Δti; and calculating second quantity IntSlope comprises the steps of:

calculating, at the end of each interruption interval Δti, the sum of all the previous electric quantities Zm(ti) to obtain a third quantity SOM:

$$SOM = \sum_k Zm(ti)_k$$

(k ranges between 1 and the number of interruption intervals Δti performed since the start of the drying cycle)

calculating second quantity IntSlope by dividing third quantity SOM by the time TIME elapsed:

$$Intslope = \frac{SOM}{\text{TIME}}$$

It should be pointed out that second quantity IntSlope substantially corresponds to the time mean of first electric quantity Zm(ti), and, according to research by the Applicant, is related to both the time-related mean moisture and the quantity/weight of the laundry.

Figure 5:
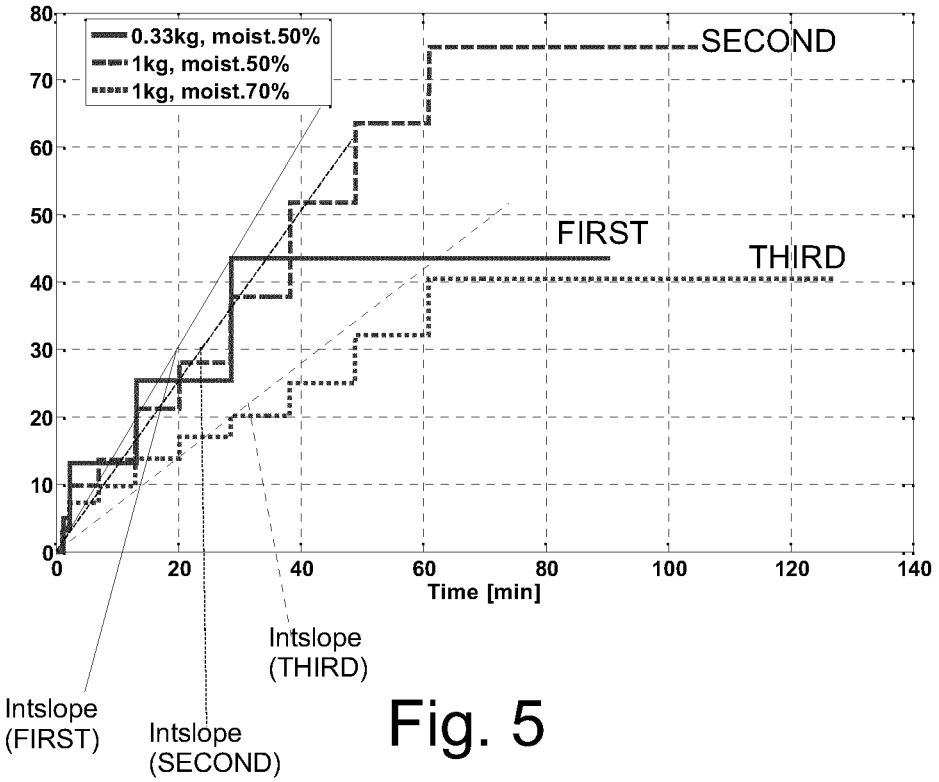
FIG. 5 shows a graph of a quantity related to the mean resistance/conductance/impedance values of the laundry, determined by tests conducted by the Applicant in three different laundry moisture/quantity conditions.

FIG. 5 shows, purely by way of example, a number of time graphs of third quantity SOM, relative to laboratory drying tests conducted by the Applicant on laundry loads with three different initial quantity/weight characteristics.

A first time graph of third quantity SOM (shown by the continuous line indicated FIRST) relates to a drying cycle of a small laundry load with a total initial weight of W1=0.33 kg, and initial moisture weighing 50% of the nominal weight of the laundry when dry.

A second time graph of third quantity SOM (shown by the dash line indicated SECOND) relates to laundry with a total initial weight of W2=1 kg, and initial moisture weighing 50% of the nominal weight of the laundry when dry.

A third time graph of third quantity SOM (shown by the dotted line indicated THIRD) relates to laundry with a total initial weight of W3=1 kg, and an initial moisture weight of 70% of the nominal weight of the laundry when dry.

As shown by the above tests, second quantity IntSlope, substantially corresponding to the variation in third quantity SOM over time, is related to both the time-related mean moisture and the total quantity/weight of the laundry.

In FIG. 5 three straight lines have been represented, Intlope (FIRST), Intlope (SECOND) and Intlope (THIRD), which slope represents the value of the second quantity IntSlope after 30 minutes from the beginning of a drying cycle.

The time graphs of first electric quantity Zm(ti) in FIG. 5 show that:

the quantity/weight of the laundry being equal (e.g. 1 kg), second quantity IntSlope is inversely proportional to the moisture in the laundry; in fact, second quantity IntSlope of a 1 kg load with 50% moisture (SECOND) is higher than that that of a 1 kg load with 70% moisture; and the moisture in the laundry being equal (e.g. 50%), second quantity IntSlope is inversely proportional to the total initial quantity/weight of the laundry; in fact, second quantity IntSlope of a 0.33 kg load with 50% moisture (FIRST) is higher than that that of a 1 kg load with 50% moisture (SECOND).

In other words, high second quantity IntSlope values (FIRST graph) indicate that drier 1 is drying a load of low quantity/weight and/or low moisture; and, conversely, low second quantity IntSlope values THIRD graph) indicate drier 1 is drying a load of high quantity/weight and/or high moisture.

Figure 6:
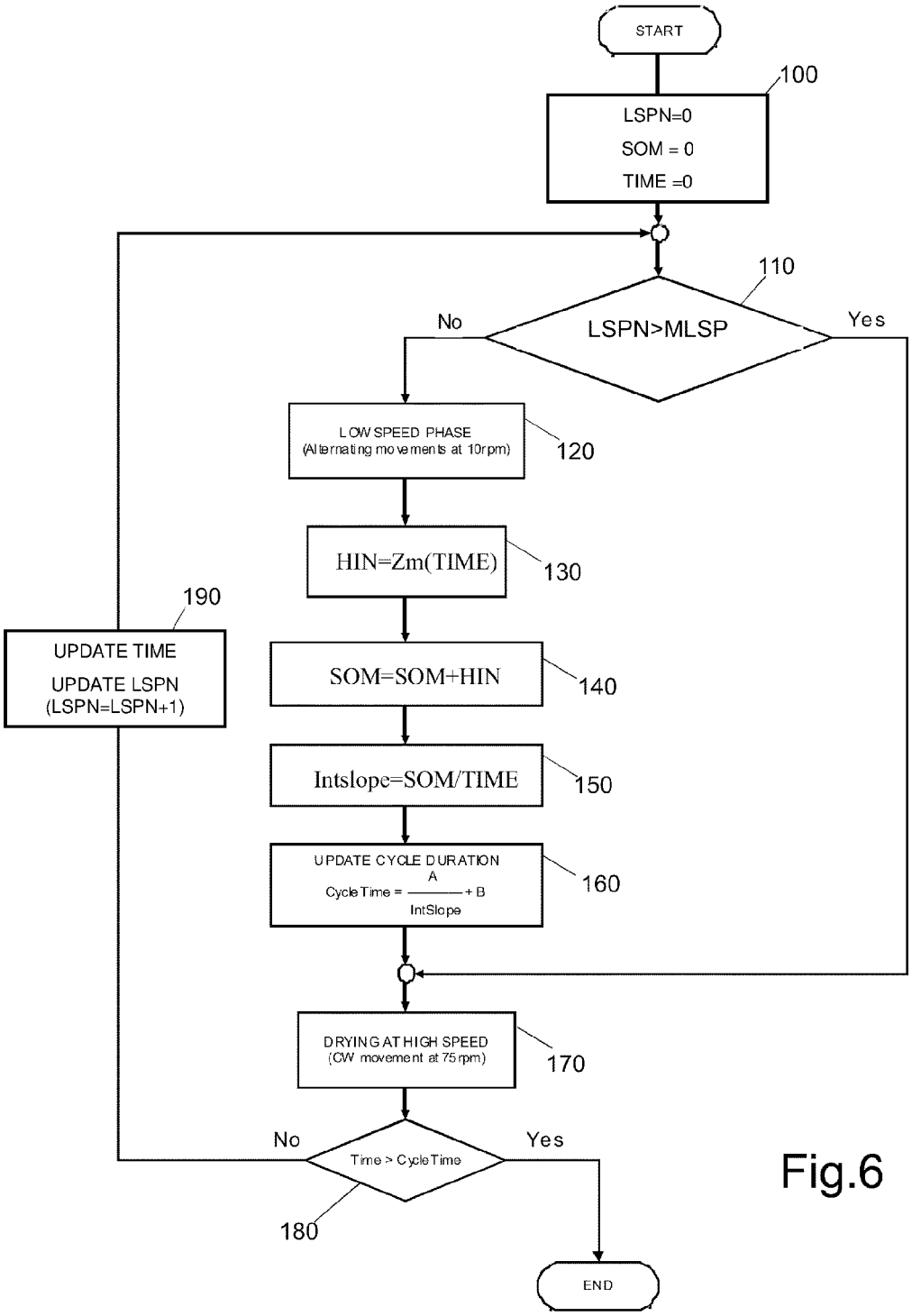
FIG. 6 shows an operation flow chart of the control method implemented by the FIG. 1 rotatable-drum laundry drier.

FIG. 6 shows a flow chart of the operations performed by electronic control unit 14 to control drier 1 during the delicate-laundry drying cycle in accordance with one possible embodiment.

The first step (block 100) corresponds to the instant the delicate-laundry drying cycle is started, and in which electronic control unit 14 initiates a number of control variables:

LSPN=1; SOM=0; TIME=0 where: TIME indicates the time elapsed since the start of the drying cycle; LSPN indicates the number of interruption intervals Δti since the start of the drying cycle; and SOM indicates the initial value of the sum at the start of the drying cycle.

Electronic control unit 14 determines whether the number of interruption intervals LSPN has reached a predetermined maximum stop threshold MLSP (block 110). In a preferred embodiment, the maximum stop threshold MLSP is about 7-10 and preferably 8 stops.

If LSPN<MLSP (NO output of block 110), i.e. if the number of interruption intervals LSPN is below maximum stop threshold MLSP, a number of second rotation cycles 21 at second rotation speed V2 are performed (block 120); and, during second rotation cycles 21, one or more measurements of the resistance/conductance/impedance Z(ti) of laundry 5 are made. Second rotation cycles 21 of drum 3 at second rotation speed V2 may be performed as described previously.

Electronic control unit 14 updates the TIME variable, calculates first quantity Zm(TIME) on the basis of the measured resistance/conductance/impedance values Z(ti), and assigns it to control variable HIN=Zm(TIME) (block 130). First quantity Zm(TIME) is preferably the mean of the resistances/conductances/impedances Z(ti) of laundry 5 measured between electrodes 23.

Electronic control unit 14 calculates third quantity SOM=SOM+HIN (block 140) and determines second quantity IntSlope=SOM/TIME (block 150).

Electronic control unit 14 calculates end-of-cycle time CycleTime as a function of second quantity IntSlope (block 160).

End-of-cycle time CycleTime is preferably calculated according to the equation:

$$CycleTime = \frac{A}{Intslope} + B$$

where B is a predetermined value indicating a minimum duration of the drying cycle, and A is a predetermined numeric constant depending on the drying machine (i.e. the thermal behavior of the machine and the temperature regulations selected).

Electronic control unit 14 controls electric motor 9 to rotate drum 3 at first rotation speed V1 (block 170).

Electronic control unit 14 determines whether the TIME variable has reached end-of-cycle time CycleTime, i.e. TIME>CycleTime (block 180). If it has not, i.e. TIME<CycleTime (NO output of block 180), electronic control unit 14 updates the TIME variable and sums one to the value of LSPN (block 190) and repeats the block 110 check. Conversely, if TIME=CycleTime (YES output of block 180), electronic control unit 14 terminates the drying cycle.

If block 110 determines the maximum number of stop intervals MLSP has been reached, i.e. LSPN=MLSP (YES output of block 110), electronic control unit 14 controls electric motor 9 to rotate or keep drum 3 rotating at first rotation speed V1 (block 170) until the end-of-cycle condition in block 180 is satisfied, i.e. until TIME=CycleTime.

Rotatable-drum laundry drier 1 has the major advantages of:

reducing matting and damage to delicate laundry, particularly woolens;

ensuring precise moisture measurement of the laundry, even when the moisture measuring sensors/electrodes are not part of the drum; and precisely calculating when to stop the drying cycle, even when the measuring sensors/electrodes are not part of the drum.

Clearly, changes may be made to the rotatable-drum laundry drier as described and illustrated herein without, however, departing from the scope of the present invention.

The invention claimed is:

1. A method of controlling a rotatable-drum laundry drier to dry delicate laundry in a drum of the rotatable-drum laundry drier; the method comprising the steps of:

feeding drying air into the drum;

rotating the drum at a variable rotation speed about an axis of rotation;

rotating the drum at a first rotation speed higher than, or equal to, a rotation speed at which centrifugal acceleration of the inner surface of the drum equals gravitational acceleration, so that the laundry is pressed by centrifugal force against the inner surface of the drum and so prevented from sliding/tumbling inside drum;

alternating first rotation cycles of said drum at said first rotation speed with one or more second rotation cycles of said drum at a not null second rotation speed lower than said first rotation speed and such that, at each second rotation cycle, at least part of the laundry slides/tumbles slowly inside the drum while remaining in contact with the inner surface of the drum and/or another part of the laundry contacting the drum;

measuring the moisture in the laundry, in the course of one or more second rotation cycles of the drum at the second rotation speed, by means of moisture sensors connected to a stationary part of the casing of the rotatable-drum laundry drier and located so that, as the drum rotates, they come into contact with the laundry inside the drum, wherein said moisture sensors comprise at least two electrodes facing the internal of the drum;

calculating, during the second rotation cycles of the drum at the second rotation speed, the moisture and the quantity/weight of the laundry; and calculating the drying cycle end time of the rotatable-drum laundry drier on the basis of the moisture and the quantity/weight of the laundry;

wherein after calculating the drying cycle end time, the drum returns to said first rotation speed.

2. A method, as claimed in claim 1, comprising two or more second rotation cycles at a second rotation speed lower than said first rotation speed and such that, at each second rotation cycle, at least part of the laundry slides/tumbles slowly inside the drum while remaining in contact with the inner surface of the drum and/or another part of the laundry contacting the drum.

3. A method as claimed in claim 2, wherein in two different second rotation cycles the direction of rotation of said drum is the same.

4. A method as claimed in claim 2, wherein said drum is stopped between two subsequent second rotation cycles.

5. A method as claimed in claim 2, wherein the second rotation speed of said drum is the same during all said second rotation cycles.

6. A method as claimed in claim 2, wherein the direction of rotation of said drum in a second rotation cycle is different from the direction of rotation of said drum in a different second rotation cycle.

7. A method as claimed in claim 2, wherein said drum is stopped between the end of a first rotation cycle and the following second rotation cycle.

8. A method as claimed in claim 2, wherein said drum is stopped between the end of a second rotation cycle and the following first rotation cycle.

9. A method as claimed in claim 2, wherein the second rotation speed of said drum in a second rotation cycle is different from the second rotation speed of said drum during a different second rotation cycle.

10. A method as claimed in claim 1, further comprising the steps of:

making interruptions in rotation of the drum at the first rotation speed;

commanding, at each interruption in rotation, one or more second rotation cycles of the drum at said second rotation speed;

alternating rotations of the drum in a first rotation direction with rotations of the drum in a second rotation direction, opposite the first, during the second rotation cycles of the drum at the second rotation speed, so as to produce controlled movement of the laundry inside the drum.

11. A method as claimed in claim 1, wherein, during each second rotation cycle of the drum at the second rotation speed, the drum performs at least a partial revolution.

12. A method as claimed in claim 1, further comprising the step of regulating the number of second rotation cycles of the drum at the second rotation speed, on the basis of the number of contacts between said moisture sensors and said laundry.

13. A method as claimed in claim 1, further comprising the step of adjusting said second rotation speed of the drum during each second rotation cycle at the second rotation speed, on the basis of the number of contacts between said moisture sensors and said laundry.

14. A method as claimed in claim 1, further comprising the step of adjusting the alternating rotation directions of the drum during said second rotation cycles at the second rotation speed, on the basis of the number of contacts between said moisture sensors and said laundry.

15. A method as claimed in claim 1, further comprising the step of adjusting the duration of each second rotation cycle at the second rotation speed, on the basis of the number of contacts between said moisture sensors and said laundry.

16. A method as claimed in claim 1, further comprising the step of adjusting the interval between two consecutive second rotation cycles at the second rotation speed, on the basis of the number of contacts between said moisture sensors and said laundry.

17. A rotatable-drum laundry drier comprising:

a drum for housing delicate laundry;

a fan configured to feed drying air into the drum;

a motor configured to rotate the drum at a variable rotation speed about an axis of rotation; and an electronic control system configured to implement a delicate-laundry drying method as claimed in claim 1.

18. A method of controlling a rotatable-drum laundry drier to dry delicate laundry in a drum of the rotatable-drum laundry drier; the method comprising the steps of:

feeding drying air into the drum;

rotating the drum at a variable rotation speed about an axis of rotation;

rotating the drum at a first rotation speed higher than, or equal to, a rotation speed at which centrifugal acceleration of the inner surface of the drum equals gravitational acceleration, so that the laundry is pressed by centrifugal force against the inner surface of the drum and so prevented from sliding/tumbling inside drum;

alternating first rotation cycles of said drum at said first rotation speed with one or more second rotation cycles of said drum at a not null second rotation speed lower than said first rotation speed and such that, at each second rotation cycle, at least part of the laundry slides/tumbles slowly inside the drum while remaining in contact with the inner surface of the drum and/or another part of the laundry contacting the drum;

measuring the moisture in the laundry, in the course of one or more second rotation cycles of the drum at the second rotation speed, by means of moisture sensors connected to a stationary part of the casing of the rotatable-drum laundry drier and located so that, as the drum rotates, they come into contact with the laundry inside the drum wherein the moisture sensors comprise at least two electrodes facing the internal of the drum; and calculating the drying cycle end time of the rotatable-drum laundry drier on the basis of the measured moisture of the laundry during the second rotation cycles;

wherein after calculating the drying cycle end time, the drum returns to said first rotation speed.

* * * * *